US007823407B2

(12) United States Patent
Lim et al.

(10) Patent No.: US 7,823,407 B2
(45) Date of Patent: Nov. 2, 2010

(54) WATER FILTER AND REFRIGERATOR HAVING THE SAME

(75) Inventors: Seung Tae Lim, Gwangju (KR); Jung Rae Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 546 days.

(21) Appl. No.: 11/889,038

(22) Filed: Aug. 8, 2007

(65) Prior Publication Data

US 2008/0142431 A1 Jun. 19, 2008

(30) Foreign Application Priority Data

Dec. 14, 2006 (KR) ..... 10-2006-0127903

(51) Int. Cl.
*F25D 23/12* (2006.01)

(52) U.S. Cl. ..... 62/338; 137/59; 210/435; 222/189.06

(58) Field of Classification Search ..... 62/337–339, 62/389–400; 210/175, 184, 186, 435; 222/146.1, 222/146.6, 189.06; 137/59–62
See application file for complete search history.

(56) References Cited

U.S. PATENT DOCUMENTS 5,398,848 A * 3/1995 Padamsee ..... 222/94
5,907,958 A 6/1999 Coates et al.

FOREIGN PATENT DOCUMENTS

KR 20-0373667 1/2005

* cited by examiner

*Primary Examiner*—William E Tapolcai
(74) *Attorney, Agent, or Firm*—Staas & Halsey LLP

(57) ABSTRACT

A water filter capable of preventing breakdown thereof due to freezing and a refrigerator having the same. The water filter includes a filter housing having entrance and exit ports to allow water to flow into and out of the filter housing, respectively, a filter member housed in the filter housing, and an expansion compensation part provided in the filter housing to compensate for expansion due to freezing of water.

16 Claims, 5 Drawing Sheets

WATER FILTER AND REFRIGERATOR HAVING THE SAME

CROSS-REFERENCE TO RELATED APPLICATIONS

This application claims the benefit of Korean Patent Application No. 10-2006-0127903, filed on Dec. 14, 2006, in the Korean Intellectual Property Office, the disclosure of which is incorporated herein by reference.

BACKGROUND OF THE INVENTION

1. Field of the Invention

The present invention relates to a water filter and a refrigerator having the same. More particularly, to a water filter capable of preventing breakdown thereof due to freezing and a refrigerator having the same.

2. Description of the Related Art

A conventional refrigerator includes a water supply apparatus for enabling drinking water to be ejected at a front side of a door of the refrigerator or an ice making apparatus capable of making ice in a storage chamber. The conventional refrigerator is provided with not only a water supply system for supplying water toward a water supply apparatus of an ice making apparatus, but also a water filter for purifying supplied water as disclosed, for example, in U.S. Pat. No. 5,907,958.

However, when the conventional refrigerator is left outdoors for a long period of time, for example, in a winter season, or a refrigerating chamber having a water filter built therein is excessively refrigerated, water in the water filter may be frozen. In this case, the water in the water filter is expanded while being frozen, and the water filter may be broken.

SUMMARY OF THE INVENTION

Accordingly, it is an aspect of the present invention to provide a water filter capable of preventing a breakdown thereof due to freezing, and a refrigerator having the same.

Additional aspects and/or advantages of the invention will be set forth in part in the description which follows and, in part, will be apparent from the description, or may be learned by practice of the invention.

The foregoing and/or other aspects of the present invention are achieved by providing a water filter which includes a filter housing having entrance and exit ports to allow water to flow into and out of the filter housing, respectively, a filter member housed in the filter housing, and an expansion compensation part provided in the filter housing to compensate for expansion due to freezing of water in the filter housing.

According to an aspect of the present invention, the expansion compensation part is provided in an interior of the filter housing while being partitioned from a space in which the filter member is installed, and the expansion compensation part includes a partition space into which water does not flow.

According to an aspect of the present invention, the water filter further includes an inner case installed in the filter housing to support the filter member, and a closing cover coupled with the inner case to form the partition space together therewith.

Further, the strength of the closing cover is weaker than that of the filter housing. Thus, when water in the filter housing expands due to freezing, the closing cover is broken to compensate for the expansion.

According to an aspect of the present invention, the closing cover is fusion-coupled with the inner case to seal the partition space.

Further, according to an aspect of the present invention, the closing cover is screw-coupled with the inner case, and the water filter further comprises a sealing member interposed between the closing cover and a coupling part of the inner case in order to seal the partition space.

According to an aspect of the present invention, the water filter further includes an inner case installed in the filter housing to enable movement of the inner case, a closing cover coupled with the inner case by sliding into the inner case so as to form the partition space together with the inner case, a coupling part extending from an edge of the inner case so as to cover an outer edge of the closing cover, and a sealing member interposed between an inner surface of the coupling part and the outer edge of the closing cover so as to seal the partition space.

According to an aspect of the present invention, the water filter further includes an elastic member installed in the partition space. Thus, when water in the filter housing expands due to freezing, the inner case moves toward the partition space so as to compensate for the expansion, and when freezing water melts, the inner case returns to an original position thereof.

It is another aspect of the present invention to provide a refrigerator which includes a body having a storage chamber, a water filter installed in the body, and a filter socket mounted on a water supply path of the body for attachment and separation of the water filter, wherein the water filter includes a filter housing coupled with the filter socket and including a connection part having entrance and exit ports, a filter member housed in the filter housing, and an expansion compensation part provided in the filter housing to compensate for expansion due to freezing of water.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
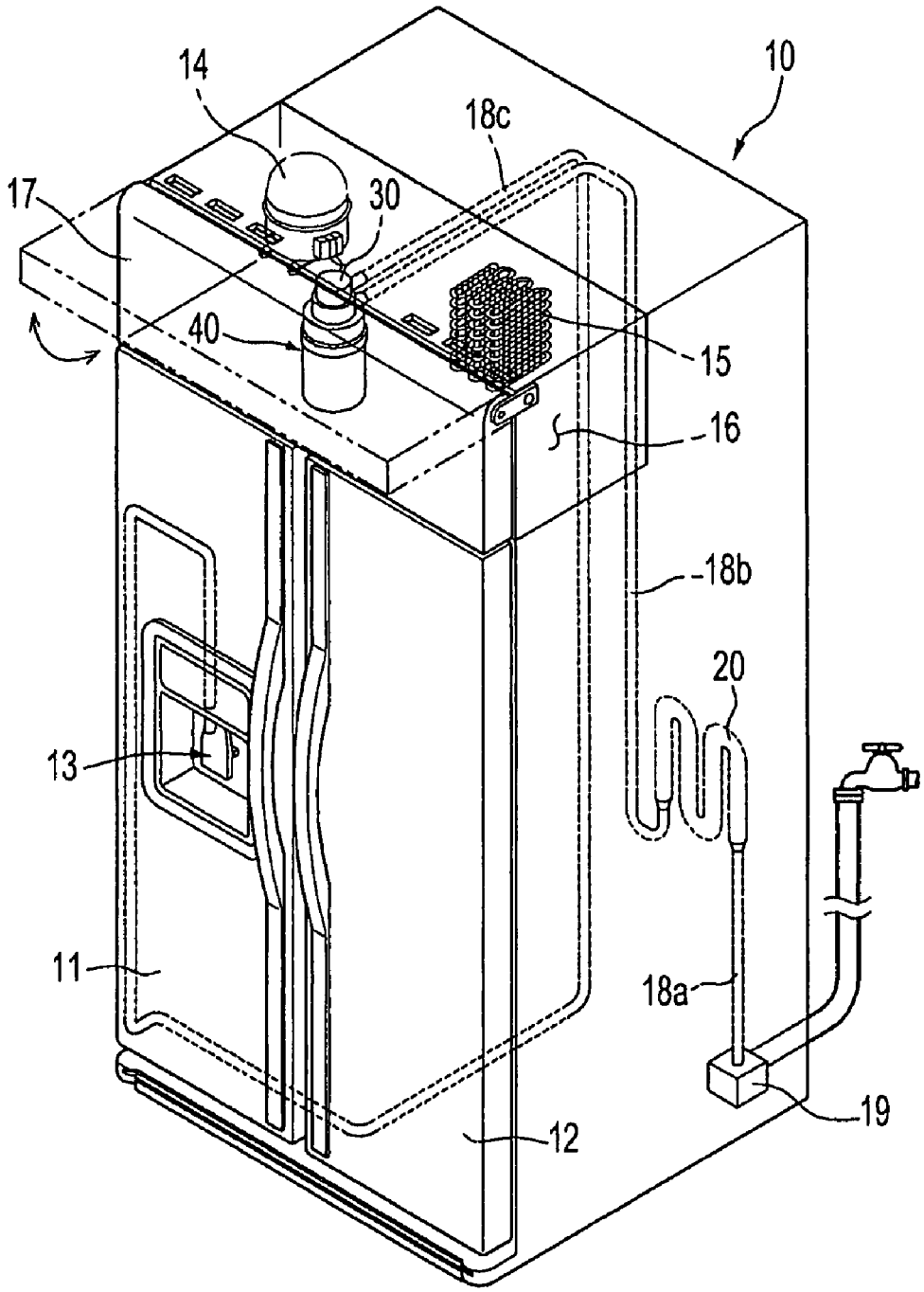
FIG. 1 is a perspective view illustrating a refrigerator having a water filter installed therein according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 illustrates a refrigerator having a water filter installed therein according to an embodiment of the present invention. The refrigerator comprises a body 10 having refrigerating and freezing chambers (not shown) mutually partitioned in an interior of the refrigerator, and doors 11 and 12 corresponding to the refrigerating and freezing chambers respectively attached at both sides of a front portion of the body 10 to open and close the refrigerating and freezing chambers.

A machine chamber 16 is provided on an upper portion of the body 10, and a compressor 14, a condenser 15 and the like are installed in the machine chamber 16. The machine chamber 16 includes a front side opened and closed by means of a rotatable cover 17. Further, the refrigerator comprises at least one evaporator (not shown) for the refrigeration of the freezing and refrigerating chambers, and a refrigerant expansion means for decompressing and expanding a refrigerant supplied to the evaporator.

A water supply apparatus 13 which enables a user to obtain water from the outside is provided to the door 11 for the freezing chamber. Water supply pipes 18*a*, 18*b* and 18*c* for supplying water toward the water supply apparatus 13 from an external water supply source are built in the body 10 and the door 11 for the freezing chamber. Further, a water supply valve 19 for controlling water supply, a cold water storage container 20 for refrigerating supplied water, and a water filter 40 for purifying supplied water are installed on a water supply path.

The cold water storage container 20 is installed in a rear of the refrigerating chamber such that water can be refrigerated by cold air from the refrigerating chamber. The water filter 40 is installed in the machine chamber 16 of an upper portion of the body 10 such that the water filter 40 can be easily exchanged. Although, FIG. 1 illustrates that the water filter 40 is installed in the machine chamber 16, the installation position of the water filter 40 is not limited thereto. That is, the position of the water filter 40 may vary, as necessary. For example the water filter 40 may be installed at a rear side of the body 10 or in the interior of the refrigerating chamber. The water supply pipes 18*a*, 18*b* and 18*c* are laid in the body 10 and the door 11 of the freezing chamber, and a portion thereof passes through the machine chamber 16 to be connected to the water filter 40. A filter socket 30 for the attachment and separation of the water filter 40 is connected to the water supply pipes 18*b* and 18*c* passing through the machine chamber 16.

Figure 2:
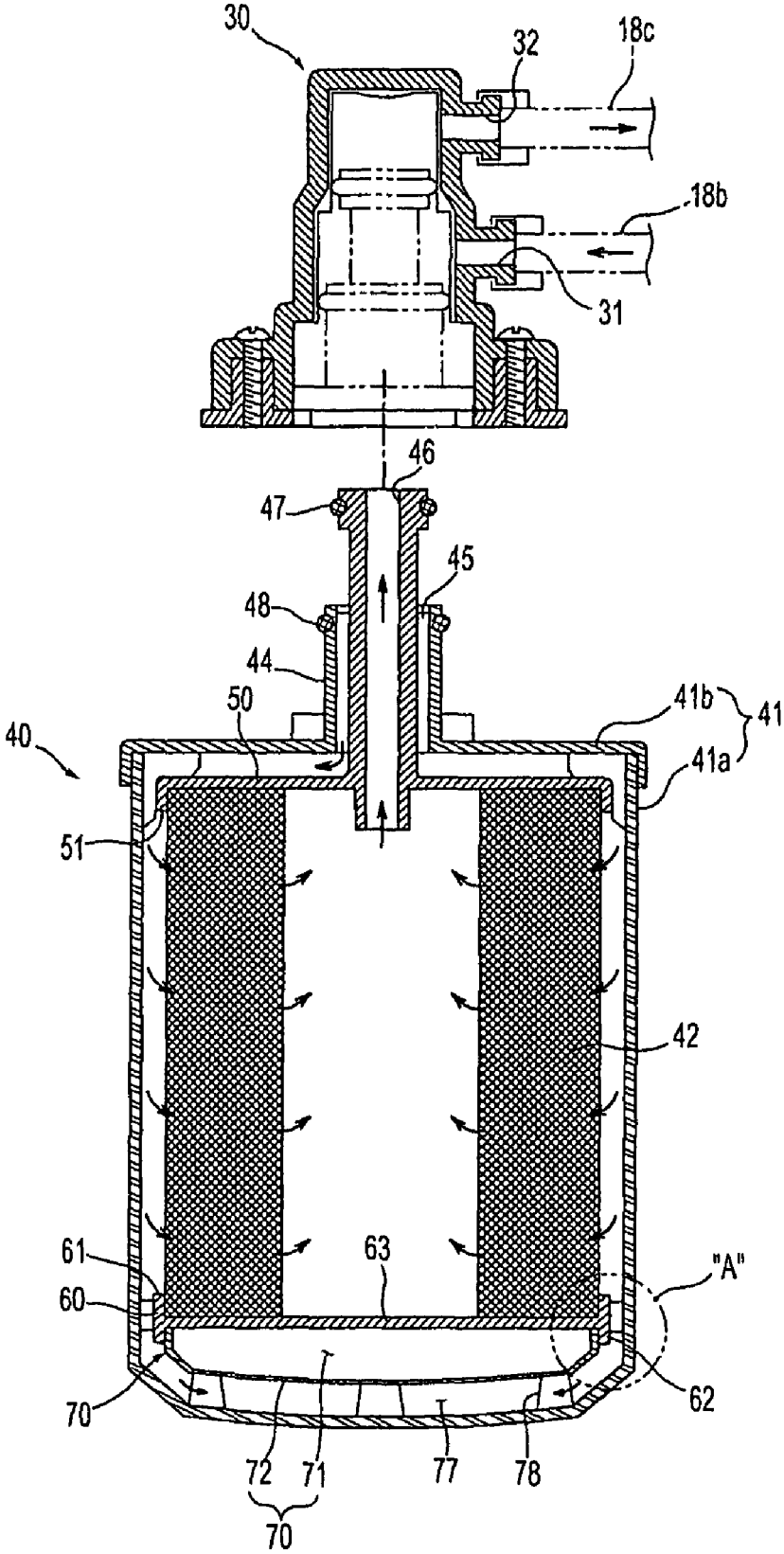
FIG. 2 is a sectional view illustrating a water filter and a filter socket according to a first embodiment of the present invention.

FIG. 2 illustrates a water filter 40 and a filter socket 30 for attaching the water filter 40 according to a first embodiment of the present invention. As shown in FIG. 2, for example, the filter socket 30 has entrance and exit ports 31 and 32 connected to fluid paths of the water filter 40 (to be described later). Water supply pipes 18*b* and 18*c* are connected to the entrance and exit ports 31 and 32, respectively.

The water filter 40 comprises a filter housing 41, a cylindrical filter member 42 installed in the interior of the filter housing 41, and an expansion compensation part 70 for compensating for expansion due to the freezing of water in the filter housing 41.

The filter housing 41 comprises a cylindrical body part 41*a* of which the bottom portion is closed, and a cover part 41*b* covering an opening of the body part 41*a*. The cover part 41*b* comprises a connection part 44 coupled with the filter socket 30, and the connection part 44 comprises entrance and exit ports 45 and 46 connected with fluid paths of the filter socket 30. The connection part 44 comprises a stepped portion for distinguishing the entrance and exit ports 45 and 46. The exit port 46, through which water is discharged, is formed at a central portion of the connection part 44, and the entrance port 45, into which water flows, is formed at an outer side of the connection part 44. Packings 47 and 48 are provided on an outer surface of the connection part 44 so as to prevent water from being leaked in a state in which the connection part 44 is coupled with the filter socket 30.

Upper and lower inner cases 50 and 60 for supporting the filter member 42 are installed in the interior of the filter housing 41. Each of the upper and lower inner cases 50 and 60 is prepared in the form of a disk having a support projection 51 or 61 at the circumference thereof. The upper and lower inner cases 50 and 60 are mounted on a top and a bottom of the filter member 42 to support the filter member 42, respectively.

The upper inner case 50 is fixed with the connection part 44 or integrally formed with the connection part 44. The upper inner case 50 supports a top of the filter member 42 and covers the top of the filter member 42 such that water flowing through the entrance port 45 of the connection part 44 is guided toward an outer surface of the filter member 42. Thus, water flowing through the entrance port 45 is supplied toward the outer surface of the filter member 42. The water is purified while passing through the filter member 42 from the outer surface of the filter member 42 to the center thereof. Then, the water is discharged through the exit port 46 of the connection part 44.

Figure 3:
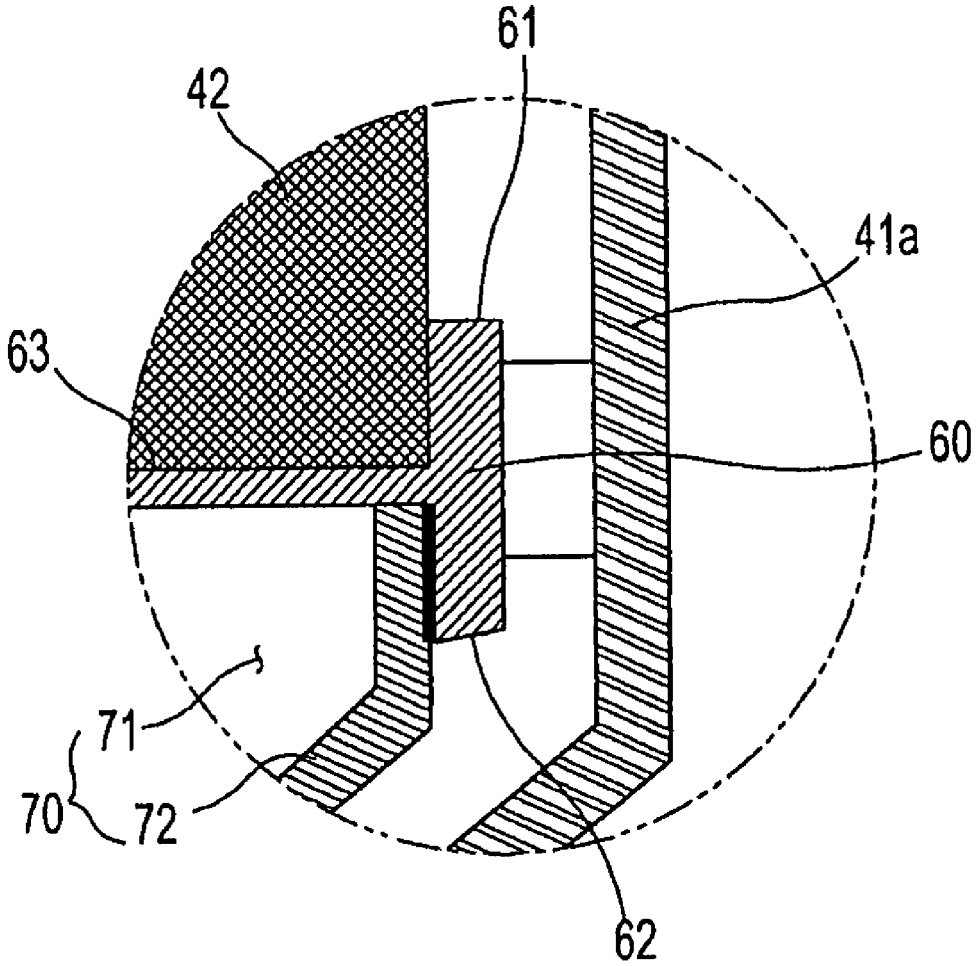
FIG. 3 is an enlarged view of "A" shown in FIG. 2.

The expansion compensation part 70 is provided at a bottom of the lower inner case 60. The expansion compensation part 70 comprises a partition space 71 partitioned from a space in which the filter member 42 is installed. The partition space 71 is confined by a closing cover 72 coupled with the lower inner case 60 at a bottom surface thereof. That is, the partition space is formed through the coupling of the lower inner case 60 and the closing cover 72. As shown in FIG. 3, the closing cover 72 is fusion-coupled with an inner surface of a coupling part 62 of which an outer surface at an opening side extends downward from an edge of the lower inner case 60 for sealing the partition space 71. Such fusion-coupling may be accomplished by rotating the closing cover 72 at a high speed to produce friction in a state in which the closing cover 72 is coupled to the lower inner case 60. Therefore, water does not flow into the partition space 71.

The strength of the closing cover 72 is weaker than that of the filter housing 41 or a disk part 63 of the lower inner case 60. To this end, the closing cover 72 is made of a material having a thinner thickness or a weaker strength than that of the filter housing 41. Further, a bottom surface of the closing cover 72 is supported by a plurality of support ribs 78 provided in an inner surface of the body part 41*a* of the filter housing 41 such that the closing cover 72 is spaced apart from the inner surface of the body part 41*a*. Since water is introduced into a space 77 beneath the closing cover 72, when water flowing into the filter housing 41 expands due to freezing, the closing cover 72 is broken, thereby compensating for the expansion of water. In a case where freezing occurs in the filter housing 41, the freezing is generally progressed toward an outer wall of the filter housing 41. Therefore, expansion due to freezing can be compensated by allowing the closing cover 72 to be broken in an initial period of freezing, in which water is frozen in the space 77 between the bottom surface of the closing cover 72 and the filter housing 41. Further, the lower inner case 60 is protected from breaking during freezing, so that residues and the like due to the breakdown of the closing cover 72 can be filtered by the filter member 42. Accordingly, the water filter 40 according to an embodiment of the present invention can prevent the filter housing 41 from being broken due to freezing even in a case where a refrigerator is left outdoors for a long period of time for the purpose of movement or the like in a winter season.

When freezing water in the filter housing 41 melts, the water filter 40 can be used again. In general, the water filter 40 is exchanged in a period of approximately six months. Since the water filter 40 is hardly placed again in a freezing condition within an exchange period, there is no problem in utilizing the water filter 40 within the exchanging period even if the function of the expansion compensation part 70 is lost due to freezing.

Although FIG. 2 illustrates that the expansion compensation part 70 is provided at a side of the lower inner case 60 in the water filter 40, the present invention is not limited thereto. That is, the position of the expansion compensation part 70 may vary, as necessary. For example, the expansion compensation part 70 may be provided at an upper side of the upper inner case 50 or at an outer circumferential portion of the filter member 42.

Figure 4:
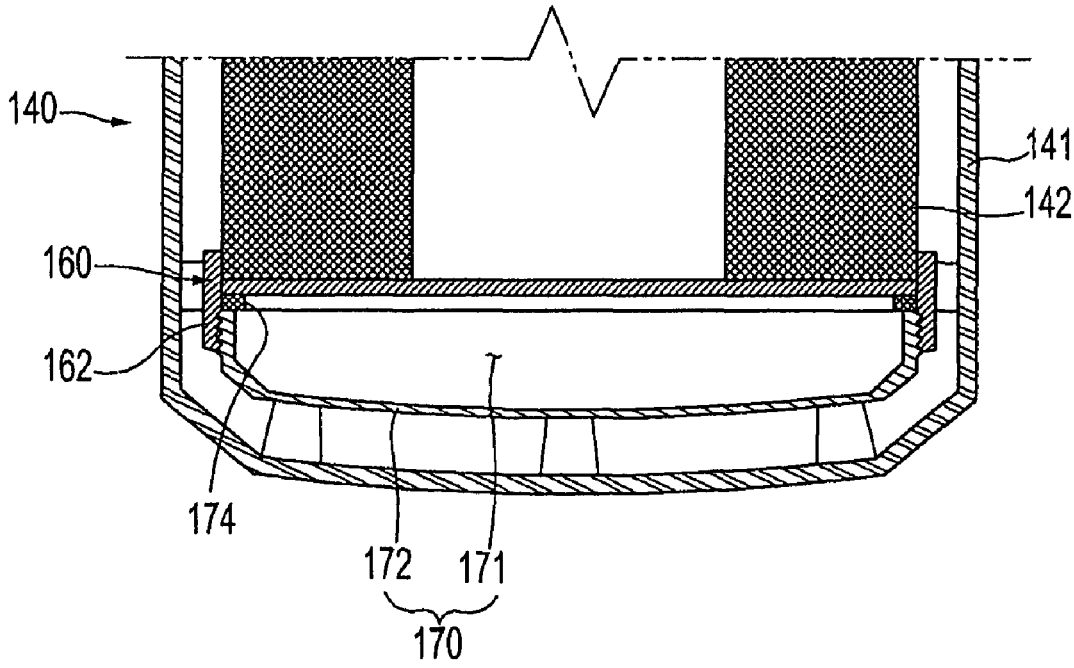
FIG. 4 is a sectional view illustrating an expansion compensation part of a water filter according to a second embodiment of the present invention.

FIG. 4 illustrates a water filter according to a second embodiment of the present invention. In the water filter 140 of the second embodiment, a closing cover 172 constituting an expansion compensation part 170 is screw-coupled with a coupling part of a lower inner case 160. Further, a sealing member 174 is installed in a portion at which the closing cover 172 is fastened to the lower inner case 160 so as to seal a partition space 171. The components of a filter housing 141, a filter member 142, an upper inner case and the like are identical to those of the first embodiment, so detailed descriptions thereof will be omitted below.

According to the second embodiment, in a case where water flowing into the filter housing 141 expands due to freezing, the closing cover 172 is broken to compensate for the expansion of water.

Figure 5:
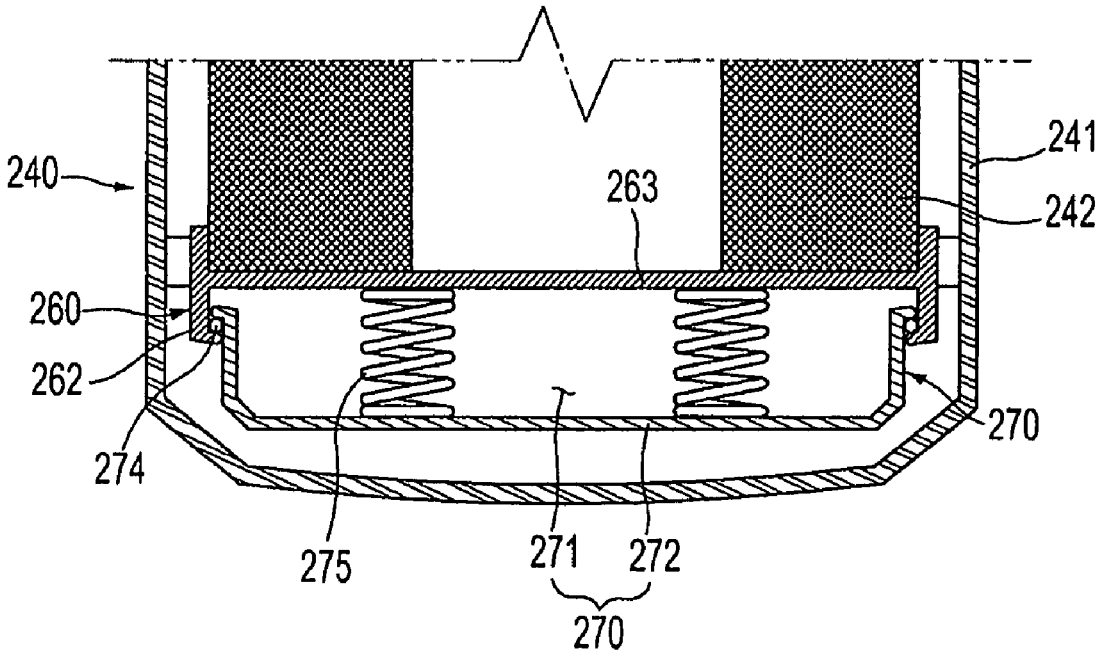
FIG. 5 is a sectional view illustrating an expansion compensation part of a water filter according to a third embodiment of the present invention.

FIG. 5 illustrates a water filter according to a third embodiment of the present invention. In the water filter 240 of the third embodiment, a closing cover 272 of an expansion compensation part 270 is coupled with a lower inner case 260 by sliding into the lower inner case 260 so as to enable the movement of the lower inner case 260 in a filter housing 241. For such coupling, a coupling part 262 extending to cover an outer edge of the closing cover 272 is provided at an edge of the lower inner case 260, and a sealing member 274 for sealing a partition space 271 is interposed between the coupling part 262 and the outer edge of the closing cover 272. Further, elastic members 275 for pressing a disk part 263 of the lower inner case 260 toward a filter member 242 are installed in the partition space 271. According to an embodiment of the present invention, for example, the elastic member 275 is made of a spring or a material having elasticity, such as rubber or silicon. Since other components are identical to those of the first embodiment, descriptions thereof will be omitted.

In the water filter 240 of the third embodiment, when water flowing into the filter housing 241 expands while freezing, the expansion can be received while the closing cover 272 is pushed toward the lower inner case 260. For this reason, the breakdown of the filter housing 241 can be prevented. Further, in a case where freezing water in the filter housing 241 melts, the elastic member 275 presses the closing cover 272. For this reason, the closing cover 272 can return to its initial position. Accordingly, the water filter 240 can prevent the breakdown of the filter housing 241 even if freezing repeatedly occurs.

As described above, since a water filter according to an embodiment of the present invention includes an expansion receiving a part for receiving expansion due to freezing in the interior of the filter housing, there is an advantage in that the breakdown of the filter housing can be prevented even in a case where freezing is produced.

Although few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A water filter, comprising:

a filter housing having entrance and exit ports to allow water to flow into and out of the filter housing, respectively;

a filter member housed in the filter housing;

an expansion compensation part provided in the filter housing, to compensate for expansion due to freezing of water in the filter housing, the expansion compensation part being provided in the filter housing while being partitioned from a space in which the filter member is installed, and comprises a partition space into which water is not introduced.

2. The water filter as claimed in claim 1, further comprising:

an inner case installed in the filter housing to support the filter member; and a closing cover coupled with the inner case to form the partition space together with the inner case.

3. The water filter as claimed in claim 2, wherein a strength of the closing cover is weaker than a strength of the filter housing, and, when water in the filter housing expands due to freezing, the closing cover is broken to compensate for the expansion of water.

4. The water filter as claimed in claim 2, wherein the closing cover is fusion-coupled with the inner case for sealing the partition space.

5. The water filter as claimed in claim 2, wherein the closing cover is screw-coupled with the inner case, and the water filter further comprises a sealing member to seal the partition space, the sealing member being interposed between the closing cover and a coupling part of the inner case.

6. The water filter as claimed in claim 1, further comprising:

an inner case installed in the filter housing to enable movement of the inner case;

a closing cover coupled with the inner case by sliding into the inner case so as to form the partition space together with the inner case;

a coupling part extending from an edge of the inner case so as to cover an outer edge of the closing cover; and a sealing member interposed between an inner surface of the coupling part and the outer edge of the closing cover so as to seal the partition space.

7. The water filter as claimed in claim 6, further comprising an elastic member installed in the partition space, and, when water in the filter housing expands due to freezing, the inner case moves toward the partition space so as to compensate for the expansion of water, and when water melts, the inner case returns to an initial position thereof.

8. The water filter as claimed in claim 4, wherein the fusion-coupling is performed by rotating the closing cover at a high speed to produce friction in a state in which the closing cover is coupled to the inner case, thereby preventing water from flowing into the partition space.

9. A refrigerator, comprising:

a body having a storage chamber;

a water filter installed in the body; and a filter socket mounted on a water supply path of the body for attachment and separation of the water filter, wherein the water filter comprises a filter housing coupled with the filter socket and comprising a connection part having entrance and exit ports, a filter member housed in the filter housing, and an expansion compensation part provided in the filter housing to compensate for expansion due to freezing of water in the filter housing, the expansion compensation part being provided in the interior of the filter housing while being partitioned from a space in which the filter member is installed, and comprises a partition space into which water is not introduced.

10. The refrigerator as claimed in claim 9, further comprising:

an inner case installed in the filter housing to support the filter member; and a closing cover coupled with the inner case to form the partition space together with the inner case.

11. The refrigerator as claimed in claim 10, wherein a strength of the closing cover is weaker than a strength of the filter housing, and, when water in the filter housing expands due to freezing, the closing cover is broken to compensate for the expansion of water.

12. The refrigerator as claimed in claim 10, wherein the closing cover is fusion-coupled with the inner case to seal the partition space.

13. The refrigerator as claimed in claim 10, wherein the closing cover is screw-coupled to the inner case, and the refrigerator further comprises a sealing member to seal the partition space, the sealing member being interposed between the closing cover and a coupling part of the inner case.

14. The refrigerator as claimed in claim 9, further comprising:

an inner case installed in the filter housing to enable movement of the inner case;

a closing cover coupled to the inner case by sliding into the inner case so as to form the partition space together with the inner case;

a coupling part extending from an edge of the inner case so as to cover an outer edge of the closing cover; and a sealing member interposed between an inner surface of the coupling part and the outer edge of the closing cover so as to seal the partition space, wherein the inner case installed in the filter housing enables movement of the inner case, and the closing cover couples with the inner case by sliding into the inner case so as to form the partition space together with the inner case.

15. The refrigerator as claimed in claim 12, further comprising an elastic member installed in the partition space, and, when water in the filter housing expands due to freezing, the inner case moves toward the partition space to compensate for the expansion of water, and when freezing water melts, the inner case returns to an initial position thereof.

16. The refrigerator as claimed in claim 12, wherein the inner case comprises an upper inner case and a lower inner case to support the filter member mounted at a top and a bottom of the filter member, wherein each of the upper and lower inner cases is of a disk form having a support projection at a circumference thereof.

* * * * *